United States Patent [19]

Stannard

[11] 4,152,089

[45] May 1, 1979

[54] METHOD AND APPARATUS FOR FORMING A CAST-IN-PLACE SUPPORT COLUMN

[76] Inventor: George E. Stannard, 2135 Overland La., Mound, Minn. 55364

[21] Appl. No.: 813,524

[22] Filed: Jul. 7, 1977

[51] Int. Cl.[2] ..... E02D 5/34; E02D 5/36

[52] U.S. Cl. ..... 405/242; 405/240; 405/232

[58] Field of Search ..... 61/53.64, 53.62, 53.66, 61/53.7, 53.52, 53.5, 56.5, 50, 53.6

[56] References Cited

U.S. PATENT DOCUMENTS

| | | | |
|---|---|---|---|
| 2,162,108 | 6/1939 | Newman | 61/53.64 X |
| 3,130,552 | 4/1964 | Bodine | 61/53.64 X |
| 3,270,511 | 9/1966 | Colle | 61/53.64 X |
| 3,344,611 | 10/1967 | Philo | 61/53.64 |
| 3,434,294 | 3/1969 | Hall | 61/53.64 X |
| 3,568,452 | 3/1971 | Stifler | 61/53.64 X |
| 3,665,717 | 5/1972 | Sweeney et al. | 61/53.64 X |
| 3,881,320 | 5/1975 | Gendron | 61/53.64 |

*Primary Examiner*—Dennis L. Taylor

*Attorney, Agent, or Firm*—Merchant, Gould, Smith, Edell, Welter & Schmidt

[57] ABSTRACT

A method and apparatus for forming a cast-in-place support column includes a ground penetration member which forms a bore when driven to a desired depth in the ground. Apparatus is provided for introducing fill material in a liquefied state under pressure into the bore to form the support column and to extract the ground penetration member from the bore.

5 Claims, 7 Drawing Figures

METHOD AND APPARATUS FOR FORMING A CAST-IN-PLACE SUPPORT COLUMN

BACKGROUND OF THE INVENTION

The present invention relates to a method and apparatus for forming a cast-in-place support column. In particular, the present invention is a method and apparatus for forming a cast-in-place concrete support column below the surface of the ground.

Foundations piles or support columns are typically utilized in supporting structures such as bridges, piers, homes, industrial plants, or other similar structures. Such support column or piles are preferably formed of concrete and utilize a minimum of steel reinforcing members. A bore is formed in the ground of the desired depth and at the preferred location of the concrete support column. The concrete fill material is then introduced into the bore thus formed and allowed to cure or harden.

A number of prior art methods and apparatus have been proposed for forming a cast-in-place support column. In one such prior art system, an auger device is utilized to form the bore followed by the introduction of concrete into the bore. This method is particularly susceptible to foreign matter such as dirt separating from the walls of the bore and intruding into the column of liquefied fill material before the fill material cures. Such intrusions are particularly detrimental to the support capacity of the pile. When such intrusions do occur, the support column is, in effect, useless and must be replaced. Considerable amounts of time and expense is expended in initially forming the support column and then removing the column into which intrusions are detected, and then replacing the support column. Typically, the defective column can only be removed by massive excavation at the support column site.

In another prior art method and apparatus, a mandrel is provided and is driven into the ground to form the support column bore. During the driving of the mandrel, the concrete fill material in liquefied form is allowed to flow by gravity into the bore being formed. It has been found that the pressure of the gravity feed of fill material may not effectively prevent earth from breaking away from the wall of the bore and intruding into the liquefied fill material as the bore is being formed. This prior art method is thus also plagued by the potential problems of intrusions into the support column. Additionally, the mandrel must be extracted utilizing a pile driving hammer rigged for extraction.

In a third prior art method and apparatus, a hollow tube or mandrel is driven into the ground to form the bore for the column. The mandrel is then filled with liquefied concrete material and the tube is then extracted from the bore by the upward and downward blows of a pile driving hammer. The mandrel has a tamping effect on the concrete material as it is extracted. In this method, the liquefied concrete is compressed by the tamping action which occurs typically at the rate of 80 times per minute. This method, however, has the disadvantage of requiring relatively expensive equipment to achieve the tamping effect which also results in a high energy expenditure and therefore expense in forming the cast-in-place pile.

These disadvantages of the prior art methods and apparatus are overcome by the present invention which provides a mandrel for forming a bore and introducing liquefied fill material into the bore under pressure to extract the mandrel from the bore. The pressure of the fill material acts against the wall of the bore to prevent the formation of intrustions in the support column as the mandrel is being extracted and fill material is being introduced into the bore. Since the pressure of the concrete fill material itself acts against the mandrel to force the mandrel upward out of the bore, in the vast majority of cases and soil conditions the present invention eliminates the relatively expensive procedure of extracting the mandrel with an appropriately rigged pile driving hammer.

SUMMARY OF THE INVENTION

The present invention includes an apparatus for forming a cast-in-place support pile and includes a ground penetration member adapted to form a bore in the earth to a desired depth. Means are provided for introducing a liquefied fill material into the bore under pressure. The apparatus also includes means for extracting the ground penetration member from the bore in response to the pressure of the liquefied fill material within the bore. The fill material is left in the bore to harden and form the support column. The apparatus of the present invention is adapted for use with a pile driving mechanism for driving the ground penetration member into the earth.

In the preferred embodiment, the ground penetration member includes a penetration plate and a hollow driving mandrel having an open end which engages the penetration plate while a second end of the driving mandrel is struck by the pile driving mechanism. A continuous side wall is provided between the first and second ends of the mandrel. The means for extracting the ground penetration member includes a partition plate which is affixed within the hollow driving member at a preselected position dividing the interior of the mandrel into upper and lower chambers. A conduit is supported within the upper chamber and affixed to the partition plate. The partition plate has an aperture which provides fluid communication between the conduit and the lower chamber. Liquefied fill material under pressure is introduced into the lower chamber through the conduit and plate aperture. The pressure of the fill material acting against the partition plate pushes the hollow mandrel upward extracting it from the bore. In the preferred embodiment, the penetration plate is circular, having a first diameter and the hollow mandrel or driving member is tubular and has an outside diameter slightly smaller than the diameter of the penetration plate. A collar is secured to the penetration plate such that the hollow mandrel engages the penetration plate within the collar. The collar maintains the tubular mandrel in the proper orientation during the driving of the penetration plate and mandrel into the earth.

The method of the present invention includes the first step of placing the ground penetration member into contact with the earth's surface at the desired column location. The ground penetration member is then driven to a desired depth to form a bore for the support column. The liquefied fill material under pressure is introduced into the bore to form the support column and to extract the ground penetration member from the bore. The fill material is allowed to harden to form the completed cast-in-place column.

In the preferred embodiment, the step of placing the ground penetration member into contact with the earth's surface includes placing a penetration plate on the earth's surface at the desired column location and placing a hollow driving mandrel into contact with the penetration plate. The hollow driving mandrel has a first open end which engages the penetration plate and a second end which is driven by a conventional pile driving hammer and a continuous side wall between the first and second ends. A partition plate is affixed within the hollow driving mandrel to divide the interior of the mandrel into upper and lower chambers. Liquefied fill material under pressure is introduced into the lower chamber whereby the pressure of the material acting against the partition plate pushes the mandrel upward extracting it from the bore. The lower chamber of the mandrel is filled with liquefied fill material prior to driving the ground penetration member to the desired depth. The pressure at which liquefied fill material is introduced into the lower chamber to extract the mandrel is preferably in the range of 500–1,000 psi.

As previously mentioned, the pressure of the liquefied fill material against the wall of the bore prevents the formation of intrusions into the finished support column. Since the driving mandrel is extracted by the pressure of the fill material introduced into the bore, the present method is much less costly than the prior art systems which required extraction by an appropriately rigged pile driving hammer. These and other advantages of my invention will become apparent with reference to the accompanying drawings, detailed description of the preferred embodiment, and claims.

DETAILED DESCRIPTION OF THE PREFERRED EMBODIMENT

Figure 1:
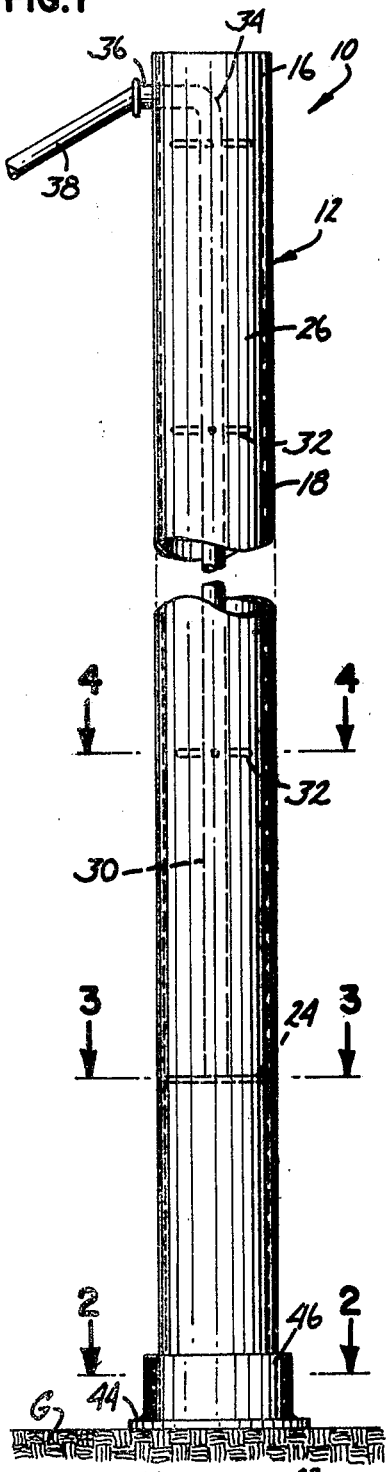
FIG. 1 is a view in elevation of the present invention prior to driving the apparatus into the ground.

Referring to the drawing, wherein like numerals represent like parts throughout the several views, the support column forming apparatus of the present invention is designated generally as 10. Column forming apparatus 10 includes a hollow driving mandrel 12 which in the preferred embodiment is a tubular member. Driving mandrel 12 will typically have a diameter of between 9 inches to 3 feet and a length of between 20 and 80 feet in accordance with the length of support column that is desired. The wall thickness of driving mandrel 12 may vary from approximately 0.3 inches to 1 inch. Driving mandrel 12 has a first or bottom end 14 which is open and a second or top end 16 which may either be open or closed. Mandrel 12 has a longitudinal axis and a continuous side wall 18 between bottom end 14 and top end 16. Side wall 18 has an outer surface 20 and an inner surface 22.

Affixed to inner surface 22 of mandrel 12 at a predetermined distance from bottom end 14 is a partition plate 24 which divides the hollow interior space of mandrel 12 into an upper chamber 26 and a lower chamber 28. A conduit 30 is disposed within upper chamber 26 and supported at spaced intervals along the longitudinal axis of mandrel 12 by a plurality of radially extending arms 32 affixed to conduit 30 and inner surface 22. Conduit 30 has a 90 degree elbow bend at 34 proximate top end 16 of mandrel 12. Conduit 30 is provided with a fitting 36 externally of mandrel 12 for connection to a conduit 38 which supplies liquefied and pressurized fill material from a source (not shown) to conduit 30. Partition plate 24 is provided with an aperture at 40. Conduit 30 is secured to partition plate 24 at aperture 40 such that fluid communication is established through aperture 40 between conduit 30 and lower chamber 28. Typically, the distance between the opening at bottom end 14 of mandrel 12 and partition plate 24 is approximately 10 feet.

Figure 5:
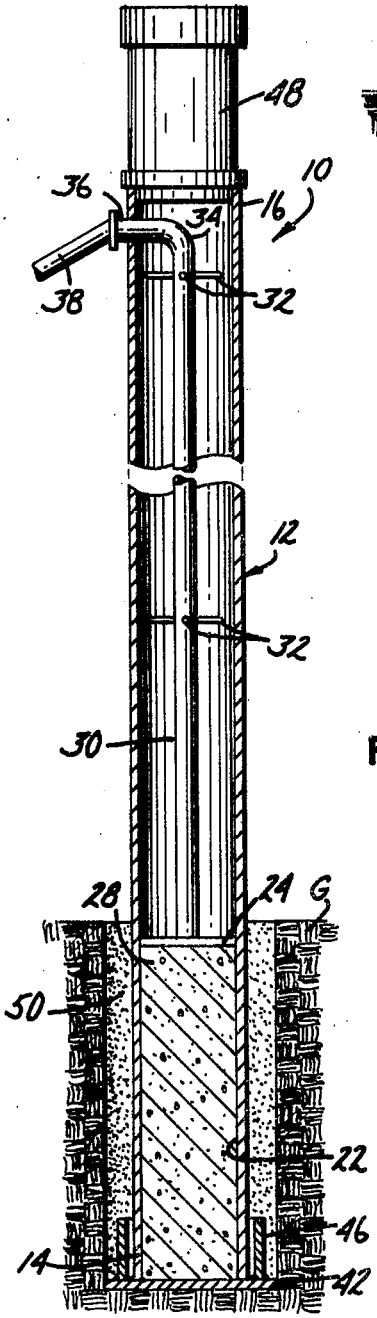
FIG. 5 is a view in elevation illustrating the step of driving the apparatus into the ground.

Support column forming apparatus 10 also includes a ground penetration plate 42 adapted to be placed into contact with the ground G at the desired column location. Penetration plate 42 has a top surface 44 which provides a contact surface for bottom end 14 of mandrel 12. In the preferred embodiment, penetration plate 42 is circular and has a diameter which is approximately 2 to 4 inches larger than the outside diameter of mandrel 12. Affixed to surface 44 of penetration plate 42 is a tubular collar member 46. Collar member 46 will typically be welded to plate 42 and have an inside diameter slightly larger than the outside diameter of mandrel 12. As shown particularly in FIG. 5, when bottom end 14 of mandrel 12 is placed into contact with top surface 44 of penetration plate 42, lower chamber 28 is substantially enclosed. Collar or boot member 46 serves to guide mandrel 12 and maintain mandrel 12 in the proper position against penetration plate 42 while the apparatus 10 is being driven into the ground as will be described in more detail hereafter. In an alternative embodiment collar 46 may extend from plate 42 upward along the entire length of mandrel 12. The outer periphery of plate 42 may then be flush with side wall 18 of mandrel 12.

The method of forming support columns utilizing apparatus 10 will now be described with particular reference to FIG. 1, and FIGS. 5–7. As illustrated in FIG. 1, penetration plate 42 is positioned on the ground surface at the desired location of a support column. Hollow driving mandrel 12 is then placed within tubular collar member 46 with bottom end 14 in contact with top surface 44 of penetration plate 42. Liquefied fill material, or grout, is then fed through conduit 38 and conduit 30 from a grout pump (not shown) into lower chamber 28. When chamber 28 is completely filled with grout, the grout pump is turned off. The grout pump will be provided with a metering gauge and a pressure gauge to monitor the grout flow from the pump. For example, in the filling of lower chamber 28, the grout pump is turned off when the flow meter registers zero which indicates that the chamber 28 closed by penetration plate 42 is filled. Additionally, the apparatus is visually observed to ensure that the mandrel 12 is not lifted from its engagement with top surface 44 of penetration plate 42 by the introduction of grout into chamber 28.

With the grout in chamber 28, the apparatus 10 is then driven into the ground to the desired depth by a pile driving hammer having a hammer member 48 which strikes top end 16 of driving mandrel 12. Any conventional pile driving hammer may be utilized to drive apparatus 10 to the desired depth in the ground. Ground penetration plate 42 forms a bore 50 which will have a diameter slightly larger than the diameter of mandrel 12. For the sake of clarity, the relative dimensions of mandrel 12, penetration plate 42, and tubular collar member 46 are somewhat exaggerated in the drawing. As previously mentioned, penetration plate 42 typically has a diameter 2 to 4 inches greater than the outside diameter of mandrel 12. Bottom end 14 of mandrel 12 is snugly received within tubular collar member 46 maintaining mandrel 12 against penetration plate 42 and in vertical alignment as mandrel 12 is driven by hammer member 48.

Figure 6:
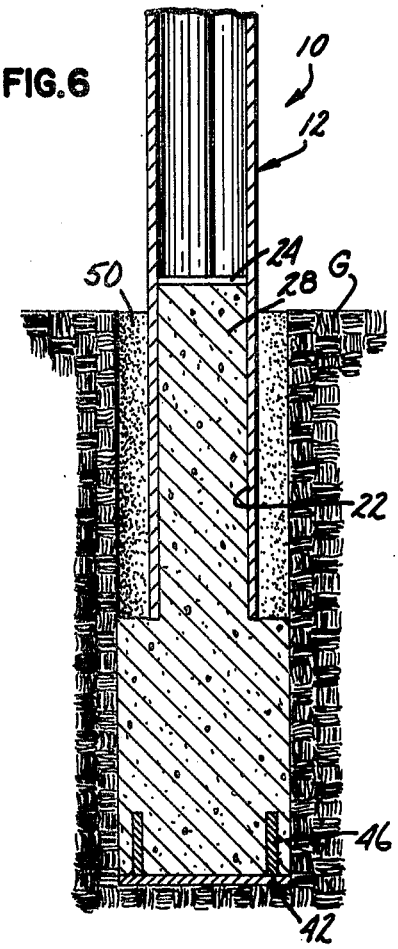
FIG. 6 is a partial view in elevation illustrating the step of introducing liquefied fill material under pressure into the bore formed by the apparatus to form the column and extract the apparatus from the bore.
Figure 7:
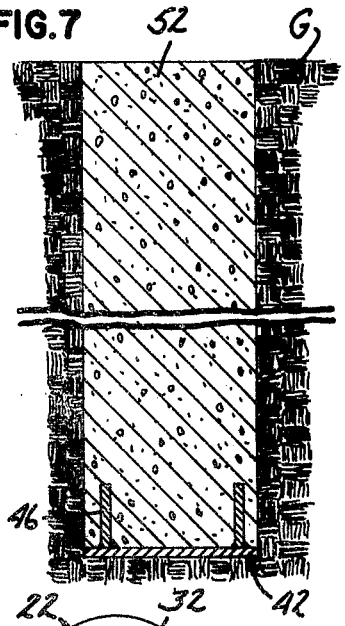
FIG. 7 is a view in elevation of a finished hardened support column with the apparatus removed from the bore.
Figure 2:
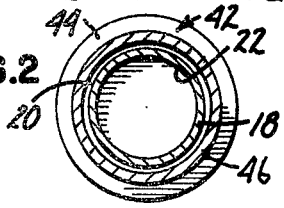
FIG. 2 is a sectional view taken along line 2—2 of FIG. 1.
Figure 3:
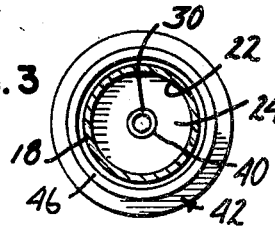
FIG. 3 is a sectional view taken along line 3—3 of FIG. 1.
Figure 4:
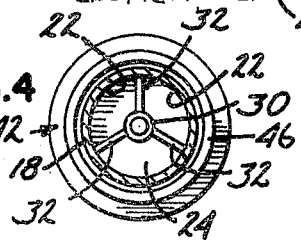
FIG. 4 is a sectional view taken along line 4—4 of FIG. 1.

When penetration plate 42 reaches the desired depth of the support column as shown in FIG. 6, the grout pump is again turned on forcing additional grout through conduit 30 and into chamber 28. The pressure of the grout within chamber 28 begins to increase and push upward against partition plate 24. As illustrated in FIG. 6, lower end 14 of mandrel 12 is lifted from engagement with ground penetration plate 42 allowing the grout to fill bore 50. Upon continued application of grout under pressure mandrel 12 is raised out of bore 50 and the grout conforms to the shape of bore 50. The pressure of the grout acting against the walls of bore 50 prevents the intrusion of dirt or other foreign matter into the support column. As previously mentioned, any conventional grout pump capable of maintaining the liquefied grout pressure between 500–1,000 psi may be utilized in the method and apparatus of the present invention. When partition plate 24 reaches the level of the ground surface, the grout pump is turned off and mandrel 12 is removed from bore 50. In some soil conditions where it is necessary, a pile driving hammer can be rigged for use as an extractor to assist removal of mandrel 12. An indicator marking will typically be applied to outer surface 20 of mandrel 12 at the position of partition plate 24 so that the operator can detect when partition plate 24 has reached the level of the ground surface.

Additional grout can then be poured if it is needed to completely fill bore 50. The grout is then allowed to harden forming a finished support column 52 having ground penetration plate 42 embedded at the foot thereof.

In the present invention when penetration plate 42 reaches the desired depth, plate 42 can be set by applying a known grout pressure from the grout pump. Thereby the maximum load that the pile will accept at plate 42 is determined. This predetermined load is simply the pressure generated by the grout pump multiplied by the area of plate 42 in contact with the grout in chamber 28. During the application of the known pressure to set plate 42, mandrel 12 may tend to extract itself from bore 50. Weights may then be applied to mandrel 12 to insure that plate 42 is set at the desired maximum load.

A number of grout mixtures may be utilized in the method and apparatus of the present invention. For example, a typical mixture includes cementitious material, fine aggregate and an admixture. The cementitious material includes cement and fly ash while the fine aggregate is typically sand. The admixture includes compositions designed, in part, to control the setting rate of the mixture. A number of manufacturers supply such admixture material. The grout mixture is combined with water such that the grout will flow readily from the grout pump into bore 50 formed by apparatus 10. The grout has a curing rate which is slow enough so that after mandrel 12 is removed from bore 50, reinforcing members can be easily inserted into support column 52. A typical grout mixture is designed to test at least 15 percent over the specified strength after 28 days of curing.

The subject invention, therefore, provides a method and apparatus for forming a cast-in-place support column which prevents the formation of intrusions in the column of fill material. Additionally, the pressure of the fill material is utilized to remove the mandrel from the bore formed by driving the mandrel into the ground. Intrusions are prevented by the pressure of the fill material or grout within the bore acting against the bore walls. While specific structure of the support column forming apparatus is disclosed herein, it will be understood that alternative equivalent structures are also contemplated within the spirit and scope of the present invention.

What is claimed is:

1. A method of forming a cast-in-place support column comprising the steps of:

(a) positioning a ground penetration plate having a first outside diameter into contact with the ground surface at the desired column location;

(b) positioning a hollow driving mandrel having a second outside diameter slightly smaller than said first outside diameter into contact with said penetration plate, said mandrel having a partition plate affixed therein dividing the interior of said mandrel into an upper chamber and a substantially enclosed lower ejection chamber;

(c) driving said penetration plate into the earth to form a bore having a diameter substantially equivalent to said first outside diameter by striking said hollow driving mandrel;

(d) then setting the maximum load that the column will support by introducing liquefied fill material to a predetermined pressure into said lower ejection chamber while simultaneously retaining said mandrel in place on said penetration plate against the force of said pressurized fill material acting on said partition plate;

(e) then releasing the retention force on said mandrel and introducing liquefied fill material under pressure into said bore through said lower chamber, said pressurized fill material acting against said partition plate thereby extracting said mandrel from said bore;

(f) allowing said liquefied fill material to harden to form the support column.

2. A method in accordance with claim 1 further comprising the step of filling said ejection chamber with liquefied fill material at a predetermined pressure prior to driving said ground penetration member to the desired depth.

3. A method in accordance with claim 1 wherein said liquefied fill material is introduced at a pressure in the range of 500–1,000 psi.

4. A method of forming a cast-in-place support column comprising the steps of:

(a) placing a ground penetration plate having a first outside diameter into contact with the ground surface at the desired column location, said ground penetration plate having a tubular column member extending upward therefrom;

(b) placing a hollow tubular driving mandrel having a second outside diameter slightly smaller than said first outside diameter within said collar member, said mandrel having a longitudinal axis, a first open end in contact with said plate, a second end, a continuous side wall between first and said second end, and a partition plate affixed within said tubular member dividing the interior of said mandrel into an upper chamber and a substantially enclosed lower chamber, said plate having an aperture therein, and conduit means supported within said upper chamber and connected to said partition plate at said aperture;

(c) filling said lower chamber with liquefied fill material under pressure;

(d) forming a bore having a diameter substantially equivalent to said first outside diameter by striking said second end of said hollow mandrel to drive said penetration plate and said mandrel into the ground to a predetermined depth;

(e) then setting the maximum load the column will support by introducing liquefied fill material to a predetermined pressure into said lower chamber while simultaneously retaining said mandrel in place on said penetration plate against the force of said pressurized fill material acting on said partition plate and tending to lift the mandrel from the bore;

(f) then releasing the retention force on said mandrel and introducing additional liquefied fill material under pressure through said conduit means and said aperture in said partition plate into said lower chamber and thereby into said bore, said liquefied fill material under pressure acting against said partition plate to raise said mandrel out of said bore; and (g) allowing said liquefied fill material to harden within said bore.

5. A method in accordance with claim 4 further comprising the step of placing reinforcing members into said column before said liquefied fill material is allowed to harden.

* * * * *